US007600606B2

(12) United States Patent
Brittingham

(10) Patent No.: US 7,600,606 B2
(45) Date of Patent: Oct. 13, 2009

(54) SILENCER TUBE WITH INTERNAL STEPPED PROFILE

(76) Inventor: Kevin Tyson Brittingham, 1434 Hillcrest Rd., Norcross, GA (US) 30093

( * ) Notice: Subject to any disclaimer, the term of this patent is extended or adjusted under 35 U.S.C. 154(b) by 30 days.

(21) Appl. No.: 11/799,152

(22) Filed: May 1, 2007

(65) Prior Publication Data

US 2008/0271944 A1 Nov. 6, 2008

(51) Int. Cl.
*F41A 21/30* (2006.01)
*F41A 21/32* (2006.01)
*F41A 21/00* (2006.01)

(52) U.S. Cl. ..... 181/223; 181/243; 89/14.4; 89/14.3

(58) Field of Classification Search ..... 181/223, 181/243, 269, 272, 273, 277, 278; 89/14.4, 89/14.3; 42/83, 77, 78, 79
See application file for complete search history.

(56) References Cited

U.S. PATENT DOCUMENTS

| | | | | | |
|---|---|---|---|---|---|
| 1,342,978 | A * | 6/1920 | Young | 89/14.3 |
| 1,667,186 | A * | 4/1928 | Bluehdorn | 89/14.3 |
| 1,770,471 | A * | 7/1930 | Hatcher | 89/14.3 |
| 2,315,207 | A * | 3/1943 | Janecek et al. | 89/14.6 |
| 2,503,491 | A * | 4/1950 | Janz | 181/223 |
| 2,792,760 | A * | 5/1957 | Hammer | 89/14.2 |
| 3,164,060 | A * | 1/1965 | Dahl | 89/14.2 |
| 3,667,570 | A | 6/1972 | WerBell, II | |
| 4,510,843 | A * | 4/1985 | Rabatin | 89/14.4 |
| 4,679,597 | A * | 7/1987 | Stein | 181/280 |
| 5,029,512 | A * | 7/1991 | Latka | 89/14.4 |
| 5,611,409 | A * | 3/1997 | Arseneau | 181/228 |
| 6,079,311 | A * | 6/2000 | O'Quinn et al. | 89/14.4 |
| 6,796,214 | B2 * | 9/2004 | Hausken et al. | 89/14.4 |
| 6,796,403 | B1 * | 9/2004 | Laughlin | 181/279 |
| 6,923,292 | B2 * | 8/2005 | Woods et al. | 181/223 |
| 7,237,467 | B1 * | 7/2007 | Melton | 89/14.4 |
| 7,308,967 | B1 * | 12/2007 | Hoel | 181/223 |
| 2007/0107590 | A1 * | 5/2007 | Silvers | 89/14.4 |

* cited by examiner

*Primary Examiner*—Edgardo San Martin
(74) *Attorney, Agent, or Firm*—Greenbaum Doll & McDonald PLLC; Glenn D. Bellamy

(57) ABSTRACT

An apparatus which provides for, noise suppressor tube with an internal tapered profile and baffle core which has an external tapered profile machined and designed to minimize friction between the two opposing surfaces which will better facilitate the disassembly of the noise suppressor unit after use.

3 Claims, 2 Drawing Sheets

SILENCER TUBE WITH INTERNAL STEPPED PROFILE

BACKGROUND OF THE INVENTION

1. Field of Invention

This invention generally relates to firearms, specifically to systems which facilitate the disassembly of a noise suppressor tube and its baffle core from each other. This system will allow the user to more effectively service and maintain the noise suppressor unit.

2. Prior Art

Previous systems exist for assembling and disassembling of a noise suppressor dating back to Hiram Maxim who invented the first noise suppressor. The majority of systems predating mine do not allow the end user to disassemble the noise suppressor for cleaning purposes. Eventually these sealed units become fouled with carbon, lead and copper which progressively reduce the effectiveness of the noise suppressor. Several designs such as the TAC65 made by Tactical Innovations, Inc. of Bonners Ferry, Idaho, utilize a very conventional disassembly method whereby the end cap of the noise suppressor is threadedly removed allowing for the removal of internal baffles. The failure of these designs is two folds. First, as the noise suppressor is shot carbon and lead will deposit on the wall of the tube and all over the baffles. As this build up occurs pushing or otherwise removing the baffles becomes very difficult often requiring a punch or other device to violently remove the stuck baffles. Second, aluminum is a very popular material choice for noise suppressors because of its light weight. Designs such as the Tactical Innovations TAC65 rely on a stainless steel tube which can withstand the aforementioned disassembly procedure where a punch or ammonia based solvents may be required. My system provides both a tapered noise suppressor tube to reduced friction between the core and tube of the noise suppressor and an ace thread which serves as a earning surface whereby the user may unscrew the core from the tube of the noise suppressor.

3. Objects and Advantages

Accordingly several objects and advantages of the present invention are (a) to allow for the disassembly of a noise suppressor by utilizing the simple process of unscrewing the core from the tube (b) to provide for a tapered noise suppressor tube which will allow for easier disassembly of a fouled noise suppressor by minimizing the overall friction between the baffle core and external tube.

(c) to provide a method of disassembly which does not require ammonia or water based solvents and does not necessitate the use of a punch to separate the tube and core of a noise suppressor.

(d) to provide a course acme thread which will not cross thread during or from repeated use and provides a caming surface which will help separate the tube and core and the noise suppressor.

Still further objects and advantages will become apparent from a consideration of the ensuing description and drawings.

SUMMARY

The present invention provides an apparatus and method for easily, and quickly disassembling a noise suppressor, specifically for removing the core from the tube of the noise suppressor. The apparatus features a tapered tube with a stepped profile and a baffle core (such as the baffle core disclosed in U.S. Patent Application Publication No.2007/0107590) which is machined to mirror the taper and stepping of the tube. By providing this taper and stepping the amount of friction between the tube and baffle core is reduced. The present invention also provides a method thru the use of a course acme thread which allows the user to assemble or disassemble the noise suppressor without the use of tools.

In general terms, the invention provides the user the ability to assemble and disassemble the noise suppressor without the use of tools or adhesives. By minimizing the contact surface between the tube and core of the noise suppressor the user is better able to remove the noise suppressor core because there will be less carbon and lead deposit that the core will have to overcome while being removed. When the core is seated within the tube carbon and lead will be limited in the areas where they are able to deposit on the internal surface of the tube. By limiting this area and providing a taper on both the tube and core of the noise suppressor it is easier for the user to disassemble the noise suppressor unit as the core is meeting no resistance after a complete revolution of the acme thread and external knob has taken place. An internal o-ring placed around the noise suppressor core provides friction between the tube and core preventing the unit from threadedly unscrewing due to the incidental vibrations resulting from the discharge of a host firearm.

In a preferred embodiment of the method, the user will unscrew the noise suppressor core from tube by grasping an external knob which is machined as part of the core. The male acme thread which is machined as part of the noise suppressor core will then be threadedly removed from the female acme thread present on the noise suppressor tube.

DRAWINGS

The novel features believed to be characteristic of the invention, together with further advantages thereof, will be better understood from the following description considered in connection with the accompanying drawings in which a preferred embodiment of the present invention is illustrated by way of example. It is to be expressly understood, however, that the drawings are for the purpose of illustration and description only and are not intended as a definition of the limits of the invention.

DETAILED DESCRIPTION OF THE PREFERRED EMBODIMENT

Figure 1:
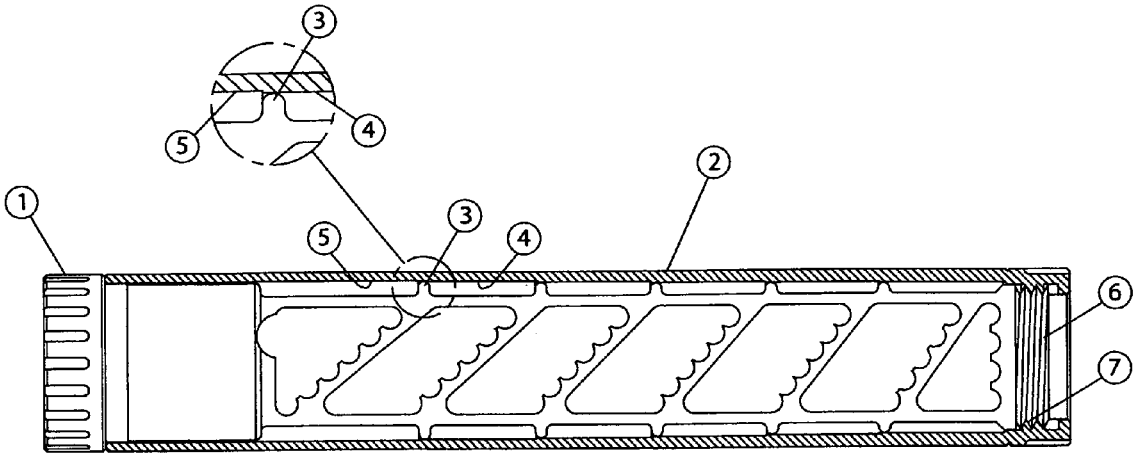
FIG. 1 shows an external side view of a noise suppressor tube with a baffle core inserted and threadedly secured.

Starting with FIG. 1, there is an illustration of an example noise suppressor tube 2 and baffle core 8 threadedly secured to each other via baffle core threads 7 and noise suppressor tube threads 6. A knurled handle 1 is used to thread baffle core 8 into noise suppressor tube 2. The internal area of the noise suppressor tube 2 is tapered. The taper is represented by the narrow taper 4 and the wide taper 5. Baffle ridge 3 is stopped against the narrow taper 4 when the noise suppressor tube 2 and baffle core 8 are threadedly secured.

Figure 2:
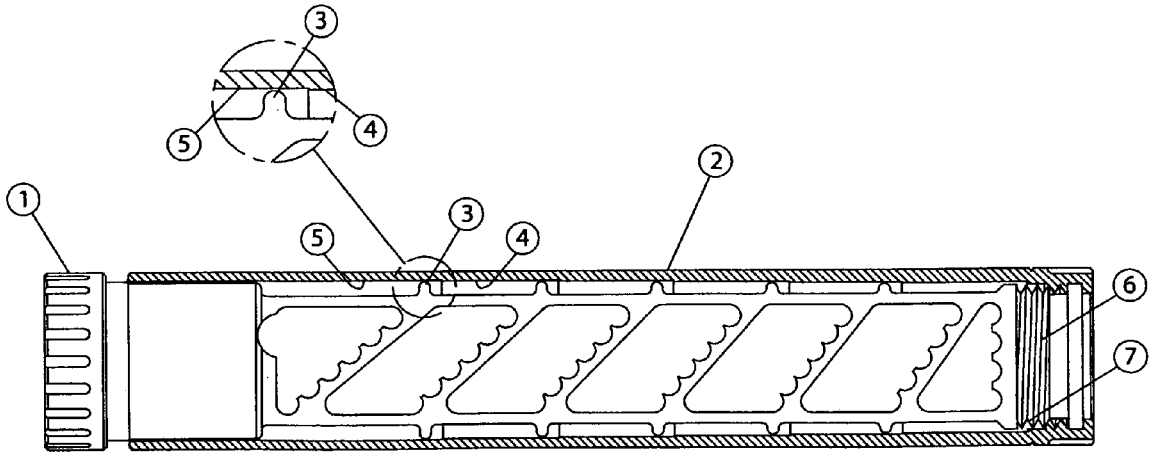
FIG. 2 shows an external side view of the noise suppressor tube with a baffle core where the baffle core is not threadedly secured to the tube.

In FIG. 2, there is illustrated an example of noise suppressor tube 2 and baffle core 8 assembled without being threadedly secured. When baffle core threads 6 and noise suppressor tube thread 7 are not threadedly secured a gap is present between baffle ridge 3 and noise suppressor tube 2.

Figure 3:
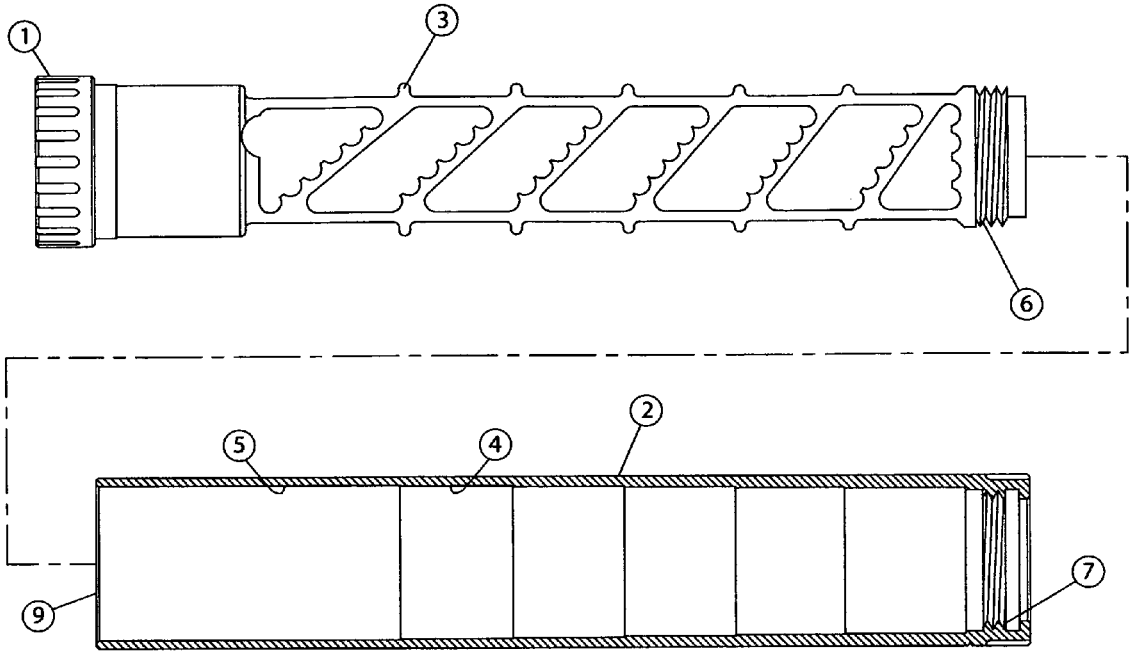
FIG. 3 is an external side view of both the suppressor tube and suppressor core separated from each other.

In FIG. 3, there is illustrated an example the noise suppressor tube 2 and the baffle core 8 separate from each other. Typically these two items are machined from aluminum but steel or other durable metals would be acceptable. Machining is the most common way to produce noise suppressor tube 2 and baffle core 8 but extrusion and metal injection molding offer other options for manufacture.

In FIGS. 1-3, there is illustrated in an example of a noise suppressor tube 2 and baffle core 8. Both items have a tapered and stepped profile so that the baffle core 8 does not contact the tube 2 prior to complete assembly. Complete assembly is achieved by threading baffle core threads into the noise suppressor tube threads.

As used herein, the word "front" or "forward" corresponds to the exit direction of the noise suppressor (i.e., to the right as shown in FIGS. 1, 2, and 3); "rear" or "rearward" or "back" corresponds to the direction opposite the exit direction of the noise suppressor (i.e., to the left as shown in FIGS. 1, 2, and 3); "longitudinal" means the direction along or parallel to the longitudinal axis of the noise suppressor tube 2 or of the baffle core 8; and "transverse" means a direction perpendicular to the longitudinal direction.

The noise suppressor tube 2 includes a back section 9 having a longitudinal bore for coaxially receiving a threaded attachment device. The noise suppressor tube 2 further includes a sound suppressing baffle core 8 which is threadedly secured via baffle core threads 6 and noise suppressor tube threads 7. Baffle core 8 including a front end having an axial opening through which a fired bullet exits when the noise suppressor tube 2 and baffle core 8 is secured to a firearm barrel.

To assembly the baffle core 8 and noise suppressor tube 2 the user must insert the front of the baffle core 8 into the rear of the noise suppressor tube 2. Once the baffle core 8 is fully inserted a knurled handle 1 must be utilized to threadedly secure baffle core 8 and noise suppressor tube 2. Tube threads 7 are engaged by baffle core threads 6 threadedly by the knurled handle 1 which is twisted by the end user.

Upon such installation, the noise suppressor core 8 is secured to noise suppressor tube 2 both longitudinally and rotationally.

To remove the baffle core 8 from the noise suppressor tube 2, knurled handle 1 is twisted to threadedly release baffle core threads 6 from noise suppressor tube 7. As the baffle core 8 is longitudinally withdrawn from the noise suppressor tube 2 the distance between the tube and core will increase due to the tapered profile which is inherent to this design.

Thus, there has been described a preferred embodiment of an apparatus for the easy, quick and reliable assembly and disassembly of a noise suppressor. Other embodiments of the present invention, and variations of the embodiment described herein, may be developed without departing from the essential characteristics thereof. Accordingly, the invention should be limited only by the scope of the claims listed below.

CONCLUSION, RAMIFICATION, AND SCOPE

Accordingly the reader will see that, according to the invention, I have provided an apparatus which will facilitate easy disassembly of the noise suppressor tube and core even after the noise suppressor unit has been used extensively in conjunction with a firearm. I have provided an acme thread which will serve as a caming surface to help disjoin the core and tube of the noise suppresser. An external knob has been provided to the end user for the purpose of disassembly and is machined as part of the baffle core. The provided external knob will serve as a method by which the core may be threadedly secured or unsecured to the tube.

While my above drawings and description contain much specificity, these should not be construed as limitations on the scope of the invention, but rather as an exemplification of one preferred embodiment thereof. For example, the taper of the tube and baffle core does not have to be stepped, a straight wall taper could be used to cut down on machining time and production cost. Further, this design can be used with a variety of materials such as steel and titanium alloys and is not limited to aluminum.

Accordingly, the scope of the invention should be determined not by the embodiments illustrated, but by the appended claims and their legal equivalents."

The invention claimed is:

1. A firearm sound suppressor, comprising:

a housing tube having at least one open end and an interior that is tapered in steps of decreasing diameter along an axial extension thereof, each step being adjacent to a larger diameter interior surface and a smaller diameter interior surface; and a baffle core having a plurality of axially spaced apart circumferential edges, extending radially outwardly from the core, sized and positioned to closely fit the interior of the tube at an axial position substantially adjacent to and at the decreased diameter surface of an interior step, whereby axial disassembly of the suppressor is facilitated by minimizing the axial movement required to displace the core to a position where each of the circumferential edges is within a portion of the tube where the interior surface is spaced from the circumferential edge.

2. The firearm sound suppressor of claim I, wherein the baffle core includes a circumferentially threaded portion positioned to engage a complementary threaded portion of the tube.

3. The firearm sound suppressor of claim 1, wherein the baffle core includes a portion which extends axially outward of the open end and which includes a gripping area for rotating the baffle core relative to the housing tube.

* * * * *